US005875656A

United States Patent [19]

Fleissner

[11] Patent Number: 5,875,656

[45] Date of Patent: Mar. 2, 1999

[54] DEVICE FOR UNIFORMLY DISTRIBUTING LIQUID TO A DYE APPLICATOR

[75] Inventor: Gerold Fleissner, Zug, Switzerland

[73] Assignee: Fleissner GmbH & Co.,Maschinenfabrik, Egelsbach, Germany

[21] Appl. No.: 651,990

[22] Filed: May 21, 1996

[30] Foreign Application Priority Data

May 22, 1995 [DE] Germany ..... 195 18 197.2
Oct. 10, 1995 [DE] Germany ..... 195 37 488.6

[51] Int. Cl.[6] ..... D06B 1/04

[52] U.S. Cl. ..... 68/205 R; 239/562; 118/325

[58] Field of Search ..... 68/205 R, 202; 239/596, 584, 558, 562; 8/149.3, 151; 118/314, 324, 325

[56] References Cited

U.S. PATENT DOCUMENTS

| | | | |
|---|---|---|---|
| 3,968,933 | 7/1976 | Waldrum | 239/562 |
| 4,086,688 | 5/1978 | Dombrowski | 68/205 R |
| 4,259,924 | 4/1981 | Smith | 118/325 |
| 4,398,665 | 8/1983 | Bryant et al. | 68/205 R |
| 4,463,583 | 8/1984 | Kruger et al. | 68/205 R |
| 4,653,295 | 3/1987 | Clifford | 68/205 R |
| 4,877,645 | 10/1989 | Bleich et al. | 118/314 |
| 5,253,807 | 10/1993 | Newbegin | 239/562 |
| 5,524,654 | 6/1996 | Nakano | 239/558 |

FOREIGN PATENT DOCUMENTS

| | | | |
|---|---|---|---|
| 1-260053 | 10/1989 | Japan | 68/205 R |
| 1-307469 | 12/1989 | Japan | 118/325 |
| 1549763 | 8/1979 | United Kingdom | 68/205 R |

*Primary Examiner*—Frankie L. Stinson
*Attorney, Agent, or Firm*—Antonelli, Terry, Stout & Kraus, LLP

[57] ABSTRACT

To supply a liquid uniformly to a dye applicator, the liquid must be divided in a specific way before the liquid reaches a strip of the applicator. This is accomplished with a hollow plate which has a large number of tube fittings on its outer circumference for the through flow of precisely constant amounts of liquid. These fittings, for treating different working widths of the applicator, must be provided at least partially with valves to close them. In order to keep the distributing plate small in diameter and simultaneously to be able to close one through flow channel or another, special channels are provided in the plate that are easy to close and can be controlled exactly with respect to liquid flow.

30 Claims, 4 Drawing Sheets

DEVICE FOR UNIFORMLY DISTRIBUTING LIQUID TO A DYE APPLICATOR

FIELD OF INVENTION

This invention relates to a device for effecting uniform distribution of liquid, especially to a dye applicator, by means of which a liquid, e.g. a liquid dye, is applied in a uniform liquid layer distributed over a working width to an advancing textile material or the like, said device comprising a distributing container for receiving the liquid to be distributed and having a central inlet and a plurality of fluid transport channels leading to outflow openings arranged on an exterior and connected to tubes extending to the applicator to produce the liquid layer, the distributing container comprising a circular hollow plate having a cavity enclosed on all sides and provided with an input opening, a plurality of output openings, with the cavity of said plate being filled with the liquid, thereby providing a radially directed liquid flow that slows down toward the outflow openings in the cavity alone.

A device of this kind is known from DE 40 38 359 A1. It has the advantage that the liquid to be distributed from a central input location over a large working width of the dye applicator not only takes place uniformly but also that the fluid flow in this distributing device is slowed uniformly for all the output locations. This is the prerequisite for a dye application that remains constantly uniform over the respective width of the textile material.

A dye applicator is generally built for a specific working width. For example, U.S. Pat. No. 5,243,841 discloses a dye applicator having a given working width. In practice, however, the arriving textile webs vary in width, possibly even within a short time. The machine manufacturer has been faced with the task of supplying dyeing devices that can cover different working widths even within a short space of time. It has been found in practice that limiting the working width in the vicinity of the liquid output of the dye applicator cannot be solved satisfactorily. This is especially true as regards the uniformity of the quantity of dye applied in the marginal area of the textile material.

SUMMARY OF THE INVENTION

To achieve this goal, the present invention provides a device for use with a dye applicator with which an existing working width can be modified in short order while the uniformity of the dye application remains constant over the working width. In particular, the present invention provides a liquid distributing device comprising a distributing container having valves for closing the throughput cross section in at least a portion of the outflow openings arranged in a circle. Care must be taken to ensure that the uniform transport of the liquid away from the distributing container remains unchanged. This is advantageously possible not by making individual outflow openings closable, but preferably by arranging the outflow openings in two circular rows on the hollow plate and by providing one of the rows, preferably the row located radially inward, with valves for selective closure.

A large number of outflow locations must be provided on the distributing container, and a large number of liquid transport channels must depart from the cavity within the container, so that the associated dye applicator is uniformly supplied with the necessary quantity of liquid over the working width, and also so that the desired working width can be exactly adjusted as a result. The number of channels or liquid outflow points required, together with tube connectors that take up space in the case of tubes leading to the dye applicator and the like, determine the diameter of the distributing container. Outflow openings can be provided on both sides of the plane of the plate, but the number of tubes can still result in an undesirable size requirement for the plate diameter. Moreover, it is essential to make sure that all the outflow openings of such a distributing container are supplied with exactly the same quantity of liquid dye per unit time.

Therefore, in the device according to the invention, with the smallest possible outside dimensions for the distributing container, an optimally large number of outflow openings can be connected with the corresponding liquid conveying tubes, with each flow stream in the distributing container simultaneously being of the same length and hence meeting the requirement that the dye applicator be supplied uniformly with liquid dye over the working width.

In the design of the device according to the invention, therefore, additional provision is made for a through flow channel to be provided in the distributing container on the outer circumference of the plate-shaped cavity, perpendicular to and on both sides of the plane of the cavity, in other words in the shape of a T; said channels being provided with equal heights or depths. Each channel is directed axially relative to the axis of the central input, and has an end communicating with the outflow openings leading to the tube fittings.

This design firstly has the advantage that having the outflow openings located opposite one another permits liquid flow streams to form in an undisturbed manner. In addition, to ensure uniform outflow of the liquid, provision must be made for the liquid to slow down in front of the respective outflow opening. This is accomplished by a constant reduction of the flow cross sections of the through flow channels in the distributing plate and also by through flow passages or openings at the end of these through flow channels that are small by comparison with the cross section of the through flow channel.

It is also especially advantageous, however, for a connecting channel extending to the outflow openings to be connected to the ends of the through flow channels and/or from the respective through flow opening. In any case, the connecting channel is directed radially, but can also be directed in the circumferential direction for additional distribution of the liquid in the plate. These connecting channels, arranged parallel to the flow surface in the hollow late of course, permit a larger number of liquid conveying tubes to be accommodated at the circumference of the distributing container, without the diameter of the container becoming too large. At the same time, however, there must be no dead corners or channels if one liquid conveying tube or another has to be shut off to influence the acting working width of the dye applicator. The through flow openings of the through flow channels are then shut off by means of valves disposed on the plate, with sealing needles that simply cut off the flow of additional liquid into the corresponding connecting channel. This also prevents spaces from forming in the distributor where liquid could stagnate.

The distributing device of this invention can be connected with a large number of tubes located in s small space so that the tubes can be supplied with exactly the same required quantity of liquid. The device is also easy to clean.

BRIEF DESCRIPTION OF THE DRAWINGS

A device according to the invention is shown in the accompanying drawing in several embodiments, wherein.

DETAILED DESCRIPTION OF THE INVENTION

Figure 1:
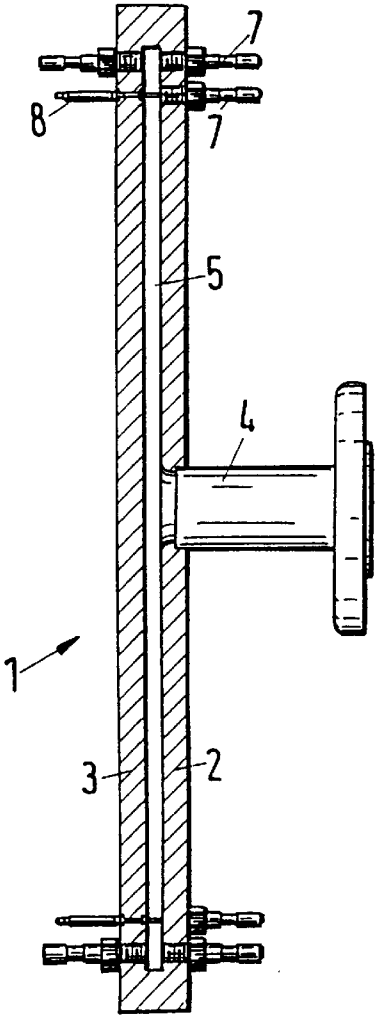
FIG. 1 shows, in cross section, a circular hollow plate with outflow openings on both sides at an outermost point on the radius as well as outflow openings on one side that are located slightly further radially inward.

The distributing container comprises a hollow plate 1. The plate is circular and has two circular wall members 2, 3, (or 2', 3' according to FIG. 5), with a space defining a cavity between the wall members; these members are connected with one another at radially external or peripheral portions in a fluid-tight manner. A supply pipe 4 terminates centrally in one wall 2, 2', the discharge end of said tube being flush with an interior wall of wall member 2; in other words not projecting into cavity 5 of the hollow plate. The diameter of pipe 4 is larger than the inside height of cavity 5.

Figure 3:
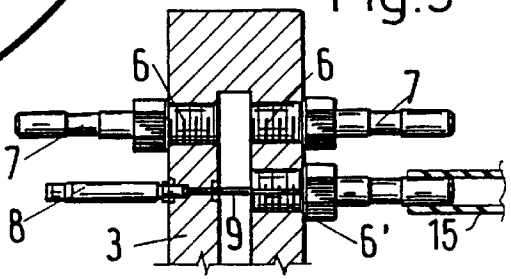
FIG. 3 shows the location of the outflow openings in the hollow plate in an enlarged view.
Figure 2:
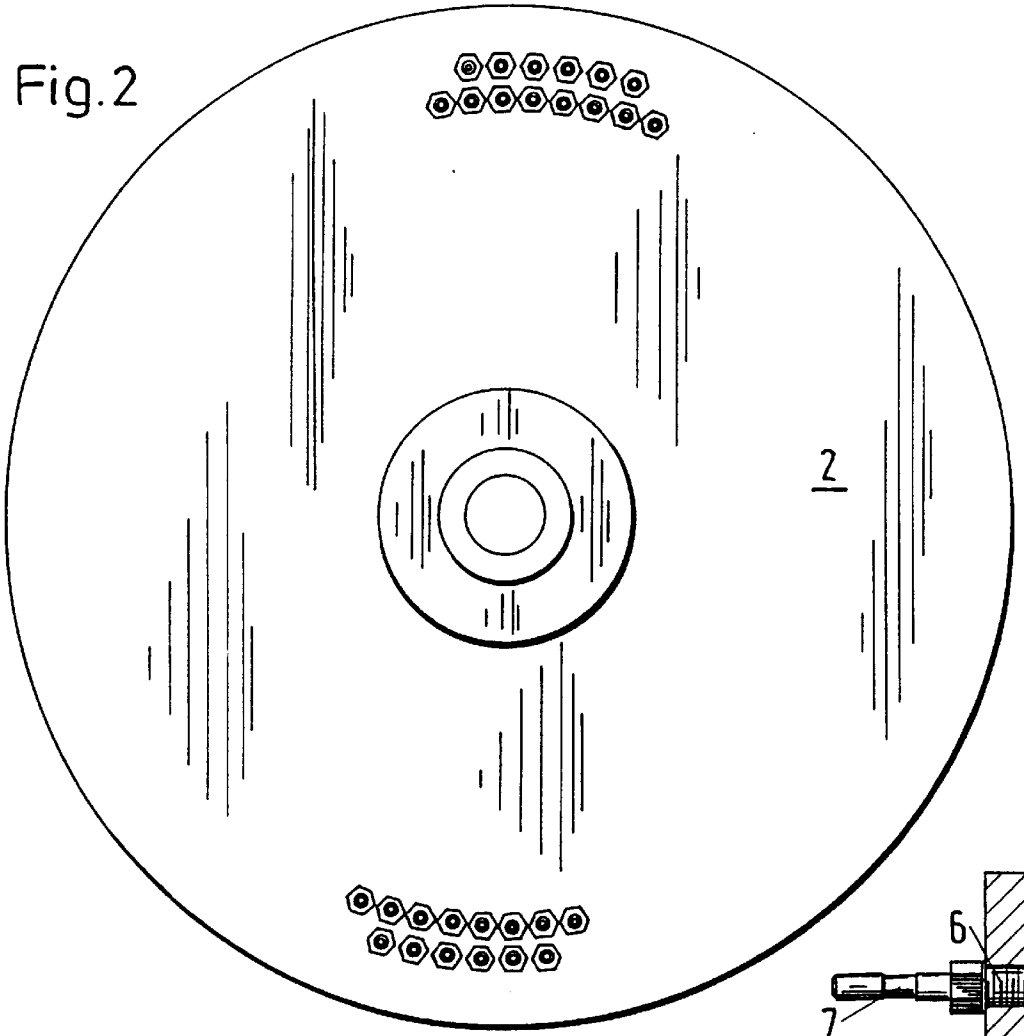
FIG. 2 is a side view of the hollow plate according to FIG. 1.

In the vicinity of the radially external or peripheral edge of hollow plate 1, holes 6 are located in both wall 2 or 2' and wall 3 or 3', said holes being uniformly distributed at a given radial distance as outflow openings. A tube fitting or connector 7 is screwed or otherwise fastened in each of holes 6, with a flexible tube or hose made e.g., of rubber or plastic, being pushed onto each of the fittings to supply the liquid flowing through to a correspondingly defined area of the dye applicator (not shown). One of these tubes or hoses is shown in FIG. 3 and is designated by reference numeral 15.

Since such a liquid distributing device is designed and manufactured for a given working width of a dye applicator, while the industry wants applicators that can accommodate different working widths without a loss of liquid dye and can supply a desired constant amount of liquid dye that is always uniformly distributed over the working width, at least some of outflow openings 6 or their tube fittings 7 are provided with valves 8 that can close the through flow cross section under electrical control. The corresponding tubes then reach the length of the working widths of the applicator that is no longer to be supplied with liquid.

Since liquid distribution must be completely uniform, a second circular row of through flow holes 6' is provided in wall 2, said holes being located near the outer edge and radially inward in the embodiment shown, with all of said holes being provided with valves 8. Valves 8 are fastened in opposite wall 3 and each have a sealing needle 9 initially projecting through cavity 5 and then into a through flow opening to be sealed. Of course, all other common valves, for example, even those that have the sealing valve located in the fitting itself, can be incorporated into the device of the invention.

Figure 4:
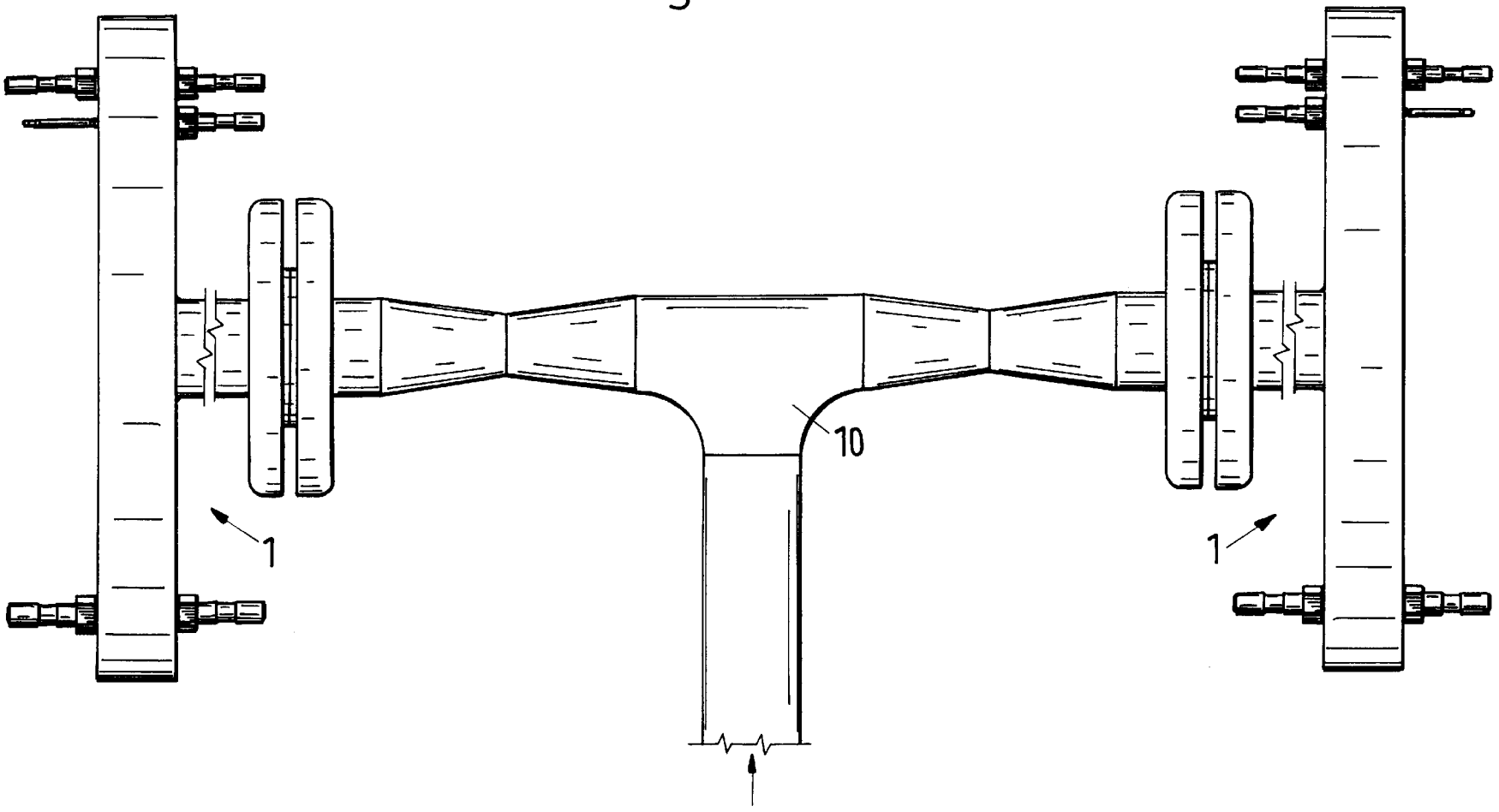
FIG. 4 shows two hollow plates according to FIG. 1 on a T-shaped distributing pipe.

This distributing plate is thus designed for two working widths. If several working widths of different sizes are to be controllable on a dye applicator with a large maximum working width, the embodiment of the distributing device according to FIG. 4 is appropriate, in which device the incoming liquid is initially halved at a T-shaped branch line 10 in order then to flow to the right and to the left, in each case into a distributing container as shown in FIG. 1. In this way, several working widths can be optimally supplied with the necessary liquid.

Figure 6:
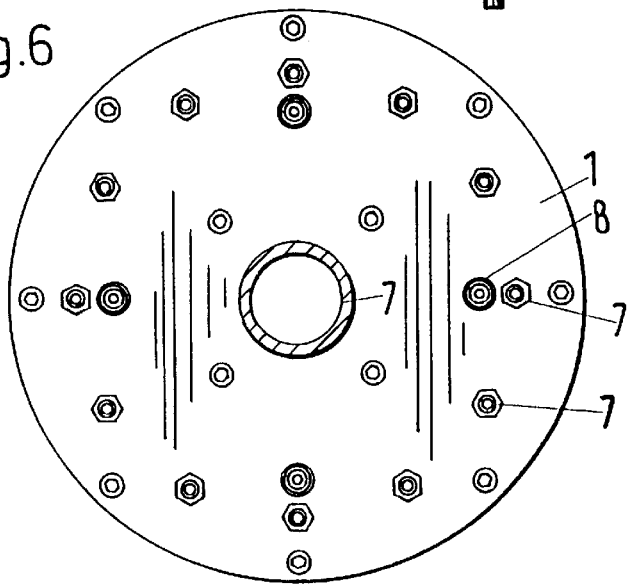
FIG. 6 is a top view of the hollow plate according to FIG. 5.
Figure 7:
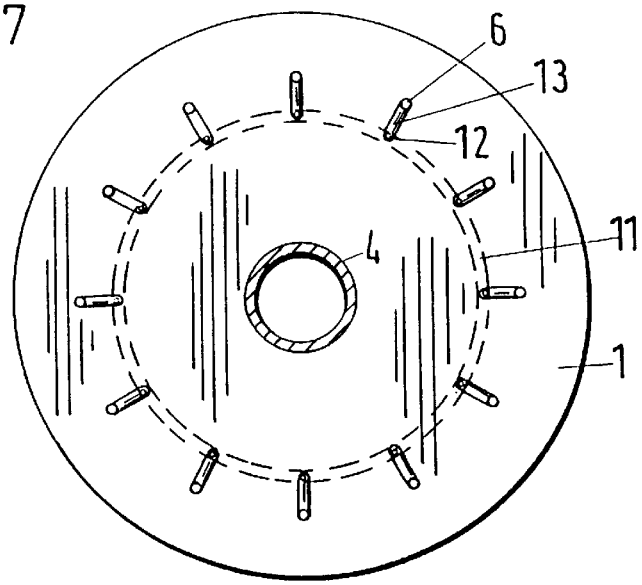
FIG. 7 is a section taken along line VII—VII according to FIG. 5.
Figure 8:
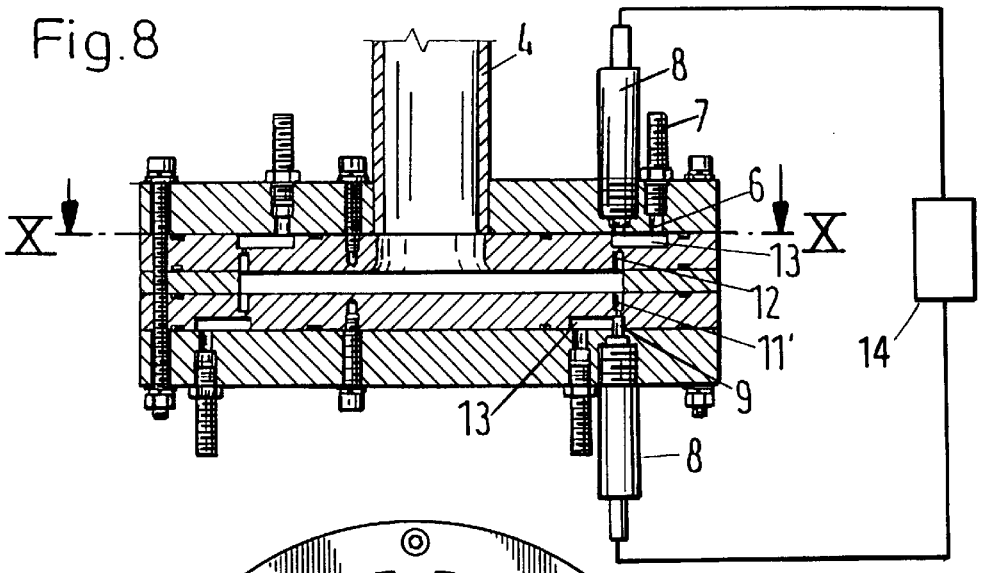
FIG. 8 shows an embodiment of the hollow plate different from that shown in FIG. 5 in cross section.

In the embodiments according to FIGS. 6 and 8, a through flow channel 11 initially abuts plate-shaped cavity 5 at a radially external portion of the cavity. This through flow channel 11 can consist of a plurality of holes extending perpendicularly to the plane of cavity 5 to communicate with the outlet openings 6 or, as shown in FIGS. 6 and 7, can consist of an annular slot extending around the periphery of cavity 5. In any event, the two slots 11' and 11" are of the same depth or height so that through flow channel 11 abuts cavity 5 to form a T at each end. At the end of the through flow channel 11, whose cross section is already reduced relative to that of cavity 5, there are a through flow opening 12 which are in turn reduced in cross section. These through flow openings 12 are distributed around the distributing plate according to FIG. 7 and serve not only to slow down the liquid to be distributed but also to communicate via the abutting connecting channels 13 with respect to outlet openings 6 provided at the end. Therefore, while each through flow channel 11 is open all the way around and is, therefore, annular or cylindrical, individual flow streams depart from through flow openings 12, connecting channels 13 abutting them and outlet openings 6, each of said streams supplying the necessary liquid to a liquid conveying tube slipped onto tube fitting 7.

Connecting channels 13 run parallel to the plane of cavity 5. According to FIG. 7, these channels extend radially outward and connect to through flow channel 11 or through flow openings 12. Thus, connecting channels 13 provide space opposite through flow openings 12 to accommodate valves 8 which abut endwise, said valves being screwed into matching holes in walls 2' or 3'. These valves usually consist of pressure piston-cylinder units whose pistons terminate in a sealing needle 9 that can close the respective through flow opening 12. As shown in FIG. 8, these units are connected to an electrically acting and activated control device 14 for opening and closing the valves. When needle 9 passes through connecting channel 13 into through flow opening 12, the flow of liquid into connecting channel 13 is blocked, and hence there is no liquid in channel 13 and, therefore, not in the liquid transport tube either, assuming that the applicator begins to operate a narrower working width at the outset. According to FIG. 6, only four pressure piston-cylinder units with valves are provided in the embodiment, so that of the twelve tube fittings with the corresponding tubes, four, in other words 25%, can be closed.

Figure 5:
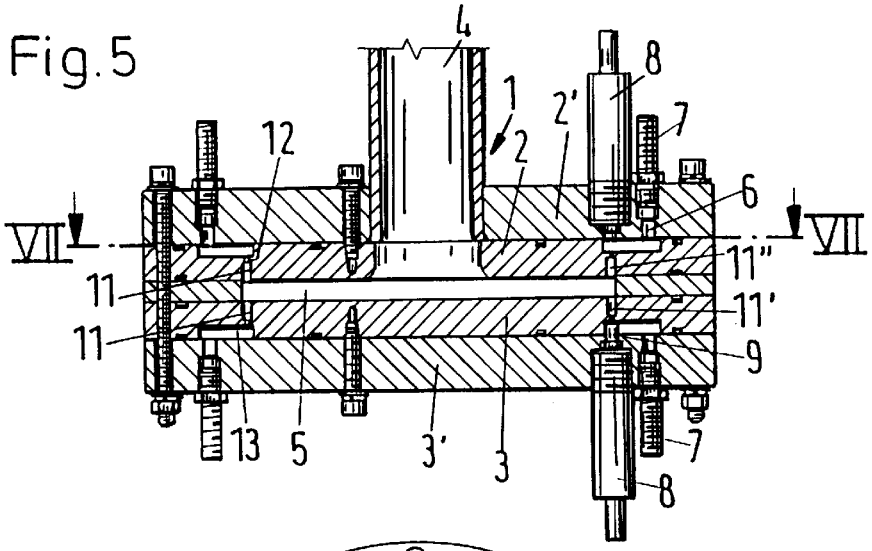
FIG. 5 shows in cross section a circular hollow plate with a design different from that shown in FIG. 1.
Figure 9:
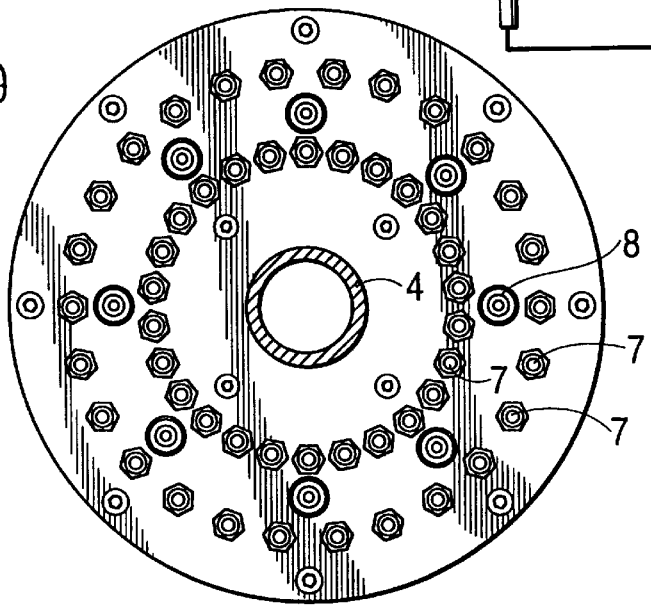
FIG. 9 is a top view of the hollow plate according to FIG. 7.
Figure 10:
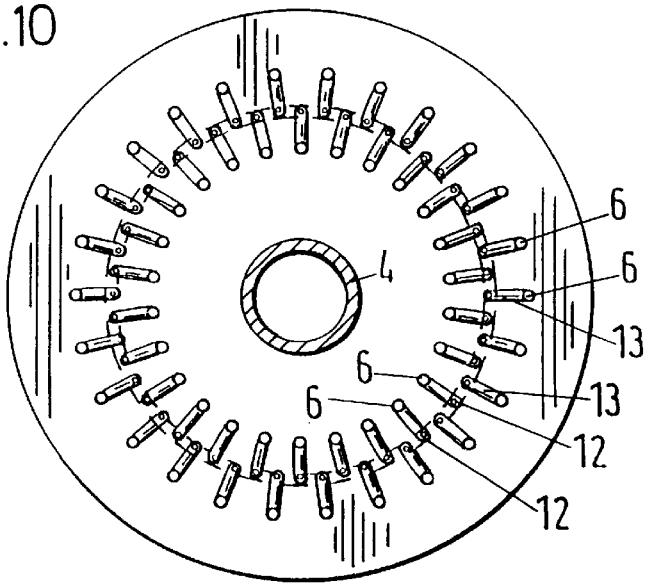
FIG. 10 is a section taken along line X—X according to FIG. 8.

The embodiment according to FIGS. 8 to 10 resembles that in FIGS. 5 to 7 and according to FIG. 9 it is designed only for more liquid conveying tubes or hoses. For this reason, therefore, initially more through flow holes 12, namely fifty-two instead of twelve are arranged in a row in through flow channel 11, and a connecting channel 13 also connects to each through flow hole 12, said channel being directed in each case around through flow channel 11 according to FIG. 10, alternately once radially outward and once radially inward. As to pressure piston-cylinder units 8, eight are provided to close through flow openings 12, but the number can readily be increased. In this manner, a considerably larger number of liquid conveying tubes can be connected to a distributor. Of course, the number of liquid conveying tubes mentioned applies only to one side of the distributor in each case; the same is true of the other.

What is claimed is:

1. A device for uniform distribution of liquid to a liquid applicator, by which liquid is dispensed in a uniform liquid layer, that is distributed over a working width, onto an advancing material in the form of a web, said device comprising a distributing container having a central supply inlet for receiving the liquid to be distributed and liquid flow channels connected to outflow openings arranged in the vicinity of its circumference for connection with the applicator, said distributing container comprising a circular hollow plate closed on all sides to define a centrally located cavity to be filled with liquid via the central supply inlet, thereby providing a radially directed liquid flow in the cavity that is slowed at the outflow openings arranged on the circumference, and valve means for sealing at least a portion of the outflow openings so as to change a cross section of throughput of liquid flow from the distributing container such that the liquid can be distributed over different working widths.

2. A device according to claim 1, wherein the flow of liquid via the liquid flow channel is controlled to supply a number of outflow openings corresponding to the different working widths of the dye applicator.

3. A device according to claim 1, wherein the supply of liquid to be supplied to the different working widths of the applicator is defined by closing or opening various outflow openings of the hollow plate.

4. A device according to claim 1, wherein the outflow openings are arranged in two circular rows on the hollow plate, with one row being a radially innermost row, said innermost row being provided with valves for selective closure.

5. A device according to claim 4, wherein the valves each consist of a mandrel or needle that can be pushed from a back side of the hollow plate through the cavity into an opening of one of the outflow openings.

6. A device according to claim 4, wherein the valve is located in a tube fitting, which is mounted on the hollow plate in an outflow opening.

7. A device according to claim 1, wherein two of said hollow plates are coupled together by a T-shaped branch line supplying liquid to each central supply inlet, each hollow plate being provided with valves to close selected outlet openings.

8. A device according to claim 1, wherein the cavity within the distributing chamber is a cylindrical space of uniform height or thickness in the shape of a circular plate or disk and at least two liquid flow channels are arranged near the circumference of the cavity, perpendicular to, and on both sides of, a center plane of the cavity, in a T-shape, with each flow channel being provided with a thickness or height traverse to the plane of equal length and aligned axially with respect to an axis of central supply inlet and ends of each channel being in communication with outflow openings.

9. A device according to claim 8, wherein each channel consists of a plurality of axially directed holes or bores.

10. A device according to claim 8, wherein each channel is provided by an annular or cylindrical slot which is open radially inward to the cavity, the thickness or depth of the slot being approximately one-half the thickness or height of the cavity.

11. A device according to claim 8, wherein the sum of the cross sections of all of flow channels is smaller than the flow cross section of the cavity.

12. A device according to claim 8, wherein through flow openings that are smaller in cross section than the cross-section of each of the flow channels are provided at the ends of the through flow channels to direct liquid toward the outlet openings.

13. A device according to claim 8 or claim 12, wherein a connecting channel is provided on each side of the cavity at the ends of the liquid flow channel or at the ends of respective additional through flow openings, each connecting channel extending up to at least one of the outflow openings.

14. A device according to claim 13, wherein each connecting channel is directed radially.

15. A device according to claim 14, characterized in that each connecting channel is directed radially outward and inward.

16. A device according to claim 15, wherein the radially directed-connecting channels are arranged staggered with respect to one another.

17. A device according to claim 14, wherein outflow opening equipped with a liquid conveying tube is provided at an end of a respective connecting channel.

18. A device according to claim 13, wherein each connecting channel is directed circularly around the central supply inlet.

19. A device according to claim 13, wherein a valve is provided to close an outflow opening of a corresponding through flow opening communicating with a liquid through flow channel.

20. A device according to claim 19, wherein the valve consists of pneumatic cylinder having a sealing needle adapted to the diameter of the additional through flow opening, which is movable through the connecting channel against interior surfaces of the through flow opening.

21. A device according to claim 1, wherein the valve means includes a plurality of valves, each valve comprising a pressure piston-cylinder unit connected to a sealing needle extending into an opening of a liquid flow channel and a control device connected to each unit for closing or opening of the valves.

22. A device according to claim 1, wherein the valve means includes a plurality of valves having actuating mechanisms operatively connected to a control device for opening and closing of the valves.

23. A device according to claim 1, wherein said outflow openings are constituted by at least two series of outflow openings, one of the at least two series being spaced inwardly a greater distance from the circumference of the distributing container as compared to another of the at least two series.

24. A device according to claim 23, wherein said valve means is for sealing an innermost series of outflow openings, relative to the circumference of the distributing container, of the at least two series of outflow openings.

25. A device according to claim 1, further comprising a supply pipe for supplying the liquid to the distributing container, said supply pipe not extending into said cavity.

26. A device according to claim 25, wherein a diameter of said supply pipe is larger than a height of said cavity.

27. A device according to claim 1, wherein the outflow openings are provided in both of opposed sides of the circular hollow plate which extend to the circumference of the distributing container.

28. A device according to claim 1, wherein flow cross section of the liquid flow channels is constantly reduced through the circular hollow plate, so as to slow the radially directed liquid in the cavity at the outflow openings.

29. A device according to claim 1, wherein the outflow openings are small relatively to a cross section of the liquid flow channels, so as to slow the radially directed liquid in the cavity at the outflow openings.

30. A device according to claim 1, wherein the central supply inlet is for supplying a liquid dye, whereby the device is a device for uniform distribution of liquid dye to a dye applicator.

* * * * *